United States Patent [19]

Matsumoto

[11] Patent Number: 5,041,835

[45] Date of Patent: Aug. 20, 1991

[54] ELECTRONIC SCANNING TYPE ARRAY ANTENNA DEVICE

[75] Inventor: Soichi Matsumoto, Hyogo, Japan

[73] Assignee: Mitsubishi Denki Kabushiki Kaisha, Tokyo, Japan

[21] Appl. No.: 504,259

[22] Filed: Apr. 4, 1990

[30] Foreign Application Priority Data

Apr. 24, 1989 [JP] Japan ..... 1-103650

[51] Int. Cl.[5] ..... H01Q 3/02; H01Q 3/22

[52] U.S. Cl. ..... 342/374; 342/368; 342/372

[58] Field of Search ..... 342/368, 372, 374, 371, 342/157, 158, 154

[56] References Cited

U.S. PATENT DOCUMENTS 3,737,899 6/1973 Georgopoulos ..... 342/374

4,667,201 5/1987 Itoh ..... 342/371

OTHER PUBLICATIONS

"Electronic Beam Steering Leads the Way", *Communication Systems Worldwide,* Sep. 1987, pp. 39, 41 and 43–44.

"Printed Crossed Slot Phased Array Antenna System for Mobile Satellite Communication", Chung et al., pp. 204–207.

*Primary Examiner*—Gregory C. Issing

*Attorney, Agent, or Firm*—Wolf, Greenfield & Sacks

[57] ABSTRACT

In an electronic scanning type array antenna device according to the present invention, the circuit is constituted to be able to select a case in which any one antenna unit out of a plurality of electronic scanning type array antenna units is operated to form a radiation pattern, or a case in which any two or more, including all, antenna units out of the plurality of electronic scanning type array antenna units are operated to form a radiation pattern; thereby a radio beam can be scanned in a desired direction in a wide range with a smaller number of antenna elements and phase shifters in comparison with that of a conventional device.

4 Claims, 7 Drawing Sheets

ELECTRONIC SCANNING TYPE ARRAY ANTENNA DEVICE

BACKGROUND OF THE INVENTION

1. Field of the Invention

The present invention relates to an antenna device for transmitting or receiving radio waves to or from an aimed object, especially to improvements in an electronic scanning type array antenna device to be used in the field of radars or satellite communications.

2. Description of the Prior Art

FIG. 1 is a block diagram showing an example of a switching array antenna device which is an example of a constitution of a conventional electronic scanning type array antenna device; in the FIG. lij (i=1 to m, j=1 to n) is a number j antenna element in a number i electronic scanning type array antenna unit; $2_{ij}$ (i=1 to m, j=1 to n) is a phase shifter for changing the phase of an exciting signal for the antenna element $l_{ij}$; $3_i$ (i=1 to m) is an antenna element composition/distribution circuit for distributing an exciting signal to an antenna element $l_{ij}$ of a number i electronic scanning type array antenna unit or for composing the signals from the antenna elements $l_{i1}$–$l_{in}$ to form a receiving signal; $4_i$ (i=1 to m) is an electronic scanning type array antenna unit comprising antenna elements $l_{i1}$–$l_{in}$, phase shifters $2_{i1}$–$2_{in}$ and an antenna element composition/distribution circuit $3_i$; 6 is a plane selection circuit which selects one unit out of m units of electronic scanning type array antennas 4 and receives/transmits a signal from/to the selected unit; 8 is a control circuit which processes the phase shift quantities to be given to the phase shifters 2 to direct a radio beam to a desired direction, and executes selective control of the plane selection circuit 6; and 9 is an input/output terminal of signals.

A transmitting operation will be explained as an example of operations in the following. Upon processing information about the direction of a beam, the control circuit 8 selects one unit out of m units of electronic scanning type array antennas 4 with the plane selection circuit 6. A signal input to the input/output terminal 9 is transmitted to an antenna element composition/distribution circuit $3_i$ of an electronic scanning type array antenna unit $4_i$ selected by the plane selection circuit 6, and it is distributed to n antenna elements $l_{i1}$–$l_{in}$ by the antenna element composition/distribution circuit $3_i$ and the distributed signals are radiated into the space from the antenna elements $l_{i1}$–$l_{in}$. At this time, phase shift quantities $\phi_{i1}$–$\phi_{in}$, expressed by the following equation (1), are given to phase shifters $2_{i1}$–$2_{in}$ for individual antenna elements $1_{i1}$–$1_{in}$ controlled by the control signal from the control circuit 8, and the signals radiated from the antenna elements $1_{i1}$–$1_{in}$ are composed in the space to form a radio beam to be radiated in a desired direction.

$$\phi_{ij}=(e_p \cdot e_r)2\pi/\lambda \ldots \quad (1)$$

where $e_p$ is a position vector expressing the position of an antenna element $1_{ij}$; $e_r$ is a unit vector in the direction of the beam; $(e_p \cdot e_r)$ is an inner product of these two vectors; and $\lambda$ is a free-space wavelength of a radio wave to be radiated.

The electric field intensity $E_i(\theta, \phi)$ is expressed by the equation (2) as shown below.

$$E_i(\theta, \phi) = \sum_{j=1}^{n} A_j g_j(\theta, \phi) e^{j\phi_{ij}}, \quad (2)$$

where $A_j$ is the amplitude of an exciting signal which excites the number j antenna element $1_{ij}$ with the antenna element composition/distribution circuit $3_i$, and $g_j(\theta, \phi)$ expresses the directivity of number j antenna element $1_{ij}$.

The directivity of an antenna element $g_j(\theta, \phi)$ is approximately expressed as an exponential function of cosines, and the amplitude becomes small at a large angle, so that the beam scanning angle of an electronic scanning type array antenna unit $4_i$ is delimited; therefore when there is a need to scan a radio beam in a wide range such as the case of mobile communication, a plurality of electronic scanning type array antenna units $4_l$–$4_m$ are used to cover the necessary scanning range in a conventional electronic scanning type array antenna device as shown in FIG. 1.

FIG. 3 is an example showing the beam coverage in the case of mobile communication; in the FIG., $10_i$ (i=1 to m) show individual beam coverages of m units of electronic scanning type array antennas 4; 12 shows a desired beam coverage. In the example shown in the figure, seven units of electronic scanning type array antenna units $4_1$–$4_7$ are needed to cover the desired beam coverage 12. In an example as shown in FIG. 4, the number of antenna elements 1 of an electronic scanning type array antenna unit is increased to widen the coverage and six units of electronic scanning type array antenna units $4_1$–$4_6$ are needed to cover the desired range. Usually, an electronic scanning type array antenna unit comprises several tens of antenna elements, and in some case it comprises thousands of antenna elements. When a wide range has to be covered as in the case of mobile communication, a plurality of antenna units as mentioned in the above are needed; therefore a large number of antenna elements 1 and a large number of phase shifters 2 are needed, as a result there occurs a problem that both weight and size of the device become large.

SUMMARY OF THE INVENTION

The present invention is invented to solve the problem in a conventional device as mentioned in the above. An object of the present invention is to provide an electronic scanning type array antenna device in which the number of antenna elements and phase shifters is decreased, and a beam can be scanned in a wide range with a small sized, light weight device.

An electronic scanning type array antenna device according to the present invention comprises a plane selection circuit for selecting any one unit out of a plurality of electronic scanning type array antenna units to supply a signal to it or to receive a signal from it, and a composition/distribution switching circuit for supplying exciting signals to any two or more, including all, antenna units out of these plural number of electronic scanning type array antenna units or composing the signals from these antenna units to form a receiving signal, whereby a single unit, a plurality of units, or the total number of units which are desired to be operated can be selected out of these electronic scanning type array antenna units to form a radiation pattern in which a beam is scanned in a desired direction.

The above-mentioned object and other objects and new features of the present invention will be made clearer by reading the following detailed description referring to the appended drawings. But the drawings are solely illustrative and not restrictive, so that the scope of the present invention is not limited by them.

DETAILED DESCRIPTION OF THE PREFERRED EMBODIMENTS

Figure 5:
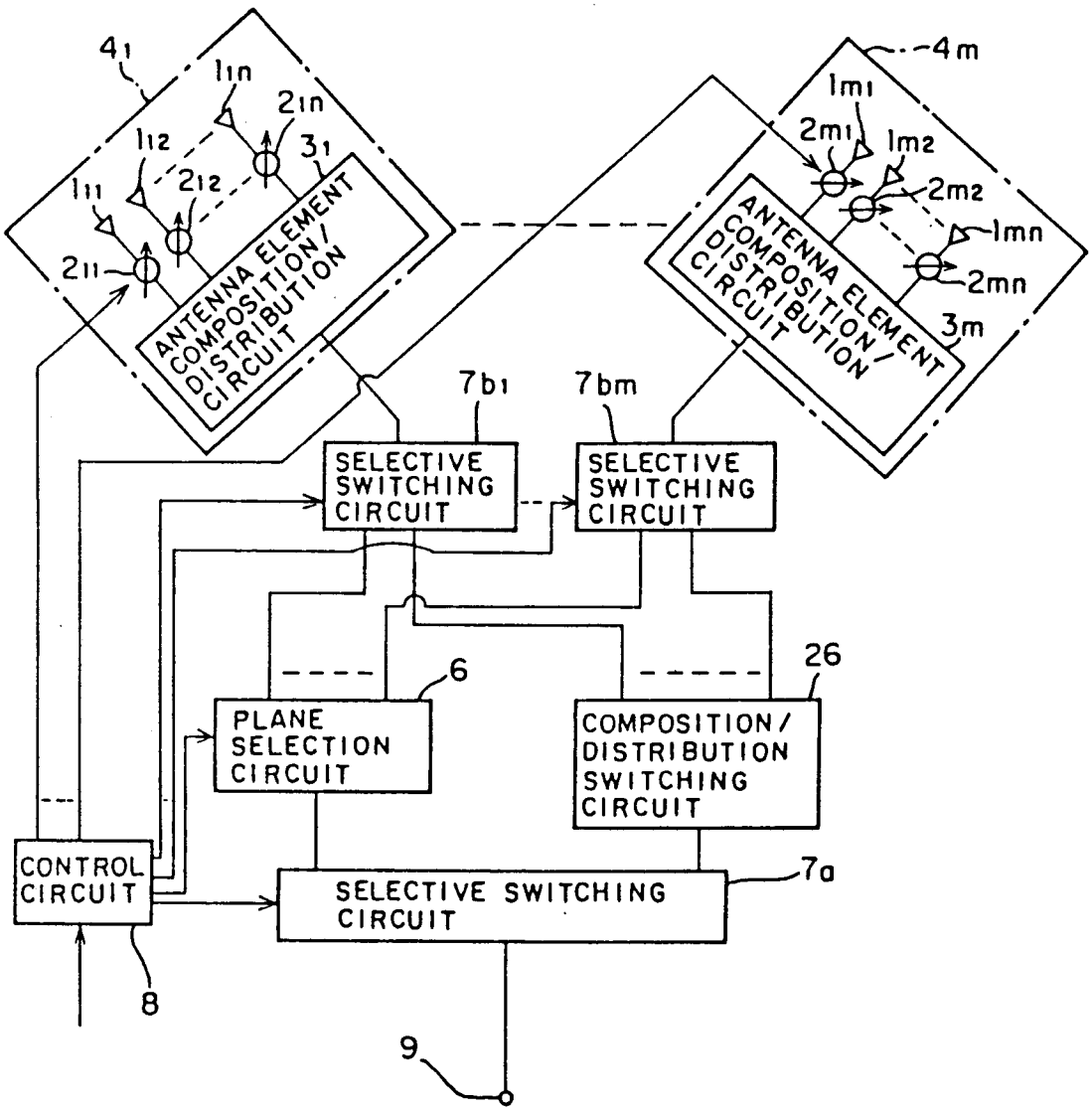
FIG. 5 is a block diagram showing an electronic scanning type array antenna device according to an embodiment of the present invention.

Now an embodiment of the present invention will be described referring to the drawings. FIG. 5 shows an electronic scanning type array antenna device according to an embodiment of the present invention; in the figure $\mathbf{1}_{ij}$ (i=1 to m, j=1 to n) is a number j antenna element of a number i electronic scanning type array antenna unit; $\mathbf{2}_{ij}$ (i=1 to m, i=1 to n) is a phase shifter for changing the phase of an excitation signal for exciting the antenna element $\mathbf{1}_{ij}$; $\mathbf{3}_i$ (i=1 to m) is an antenna element composition/distribution circuit for distributing excitation signals to antenna elements $\mathbf{1}_{i1}$–$\mathbf{1}_{in}$ or for composing the signals from antenna elements $\mathbf{1}_{i1}$–$\mathbf{1}_{in}$ of the number i electronic scanning type array antenna unit; $\mathbf{4}_i$ (i=1 to m) is an electronic scanning type array antenna unit comprising antenna elements $\mathbf{1}_{i1}$–$\mathbf{1}_{in}$, phase shifters $\mathbf{2}_{i1}$–$\mathbf{2}_{in}$ and an antenna element composition/distribution circuit $\mathbf{3}_i$; 6 is a plane selection circuit which selects any one unit out of m units of electronic scanning type array antenna 4 and receives/transmits a signal from/to the selected one; 26 is a composition/distribution switching circuit for supplying excitation signals to a number of array antenna units including the total number of array antenna units out of m units of electronic scanning type array antennas 4 or for composing the signals received from the above-mentioned array antenna units 4 to form a receiving signal; 7 is a selective switching circuit for selecting the plane selection circuit 6 or the composition/distribution switching circuit 26; 8 is a control circuit for processing the phase shift quantities to be given to the phase shifters 2 for directing the beam to a desired direction, and for controlling the switching of the plane selection circuit 6 and the selective switching circuit 7; and 9 is an input/output terminal of a signal.

Figure 6:
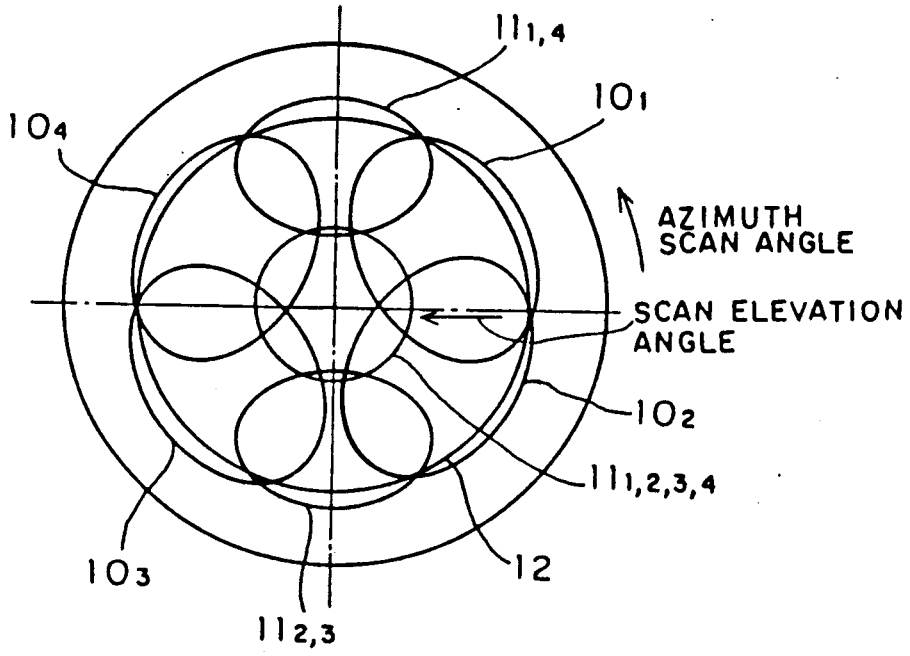
FIG. 6 is a chart showing the beam coverage of an electronic scanning type array antenna device according to the present invention.

FIG. 6 shows an example of beam coverages of an electronic scanning type array antenna device; $\mathbf{10}_i$ (i=1 to m) shows each of the beam coverages of m units of electronic scanning type array antennas 4; $\mathbf{1}_{i,j,k}$, . . . shows a beam coverage when electronic scanning type array antenna units $\mathbf{4}_i$, $\mathbf{4}_j$, $\mathbf{4}_k$, . . . are operated and their signals are composed; and 12 is a desired beam coverage (in the figure there is shown a case where m=4).

Next, a transmitting operation will be described as an example of operation. At first, the information of a desired beam direction is processed in the control circuit 8, and then it is judged that in which beam coverage among the beam coverages shown in FIG. 6 the desired beam direction lies: i.e., among beam coverages $\mathbf{10}_l$–$\mathbf{10}_m$ each of which is obtained when any one unit of electronic scanning type array antennas 4 is operated, beam coverages $\mathbf{11}_{1,4}$ and $\mathbf{11}_{2,3}$ each of which is obtained when two units of electronic scanning type array antennas 4 are operated, and a beam coverage $\mathbf{11}_{1,2,3,4}$ which is obtained when all m units of electronic scanning type array antennas 4 are operated. Based on the judgment the plane selection circuit 6, and the selective switching circuits 7*a* and 7*bi* (i=1 to m) are operated.

When a desired beam direction lies in the beam coverage 10*i* (i=1 to m) which is obtained when any one unit of electronic scanning type array antenna $\mathbf{4}_i$ out of m units of electronic scanning type array antennas 4 is operated, a signal input to the input/output terminal 9 is transmitted by the selective switching circuit 7*a* to the plane selection circuit 6 which selects one unit out of m units of electronic scanning type array antennas 4, and from the plane selection circuit 6 the signal is transmitted to the selected electronic scanning type array antenna $\mathbf{4}_i$ according to the signal from the control circuit 8. The signal is distributed to n phase shifters $\mathbf{2}_{i1}$–$\mathbf{2}_{in}$ by the antenna element composition/distribution circuit $\mathbf{3}_i$ of the array antenna $\mathbf{4}_i$, and these signals are radiated into the space through n antenna elements $\mathbf{1}_{i1}$–$\mathbf{1}_{in}$. At this time, each of these phase shifters $\mathbf{2}_{i1}$–$\mathbf{2}_{in}$ is respectively given a proper phase shift quantity by the control signal from the control circuit 8, and the signals radiated from n antenna elements are composed in the space to be a beam having a directivity in the desired direction.

When the desired beam direction is in the beam coverage $\mathbf{1}\mathbf{1}_{i,i+l}$ (in FIG. 6, $\mathbf{11}_{2,3}$ and $\mathbf{11}_{4,1}$) which is obtained when two electronic scanning type array antenna units $\mathbf{4}_i$ and $\mathbf{4}_{i+1}$ are operated, a signal input to the input/output terminal 9 is transmitted to the composition/distribution switching circuit 26 by the selective switching circuit 7*a* and it is distributed to two units of electronic scanning type array antennas $\mathbf{4}_i$ and $\mathbf{4}_{i+1}$ through two selective switching circuits 7bi and $7_{bi+1}$. Each of these distributed signals is further divided into n signals with the antenna element composition/distribution circuit $\mathbf{3}_i$ or $\mathbf{3}_{i+1}$ of the electronic scanning type array antenna 4*i* or $\mathbf{4}_{i+1}$, and each group of the n signals is supplied to n antenna elements $\mathbf{1}_{i1}$–$\mathbf{1}_{in}$ and to the other n antenna elements $\mathbf{1}_{(i+1)1}$–$\mathbf{1}_{(i+1)n}$ through n phase shifters $\mathbf{2}_{i1}$–$\mathbf{2}_{in}$ and the other n phase shifters $\mathbf{2}_{(i+1)1}$–$\mathbf{2}_{(i+1)n}$, respectively, and they are radiated into the space from the antenna elements. At this time, proper phase shift quantities are given to 2n phase shifters $\mathbf{2}_{i1}$–$\mathbf{2}_{in}$ and $\mathbf{2}_{(i+1)1}$–$\mathbf{2}_{(i+1)n}$ by control signals from the control circuit 8; therefore the signals radiated from 2n antenna elements, $\mathbf{1}_{i1}$–$\mathbf{1}_{in}$ and $1_{(i+1)1}$–$1_{(i+1)n}$, are composed in the space to be radiated in a desired direction.

When the desired beam direction is in the beam coverage $1l_{1,2,3,}$. . . m (in FIG. 6, $1l_{1,2,3,4}$) which is obtained when all m electronic scanning type array antenna units 4 are operated, a signal input to the input/output terminal 9 is transmitted to the composition/distribution switching circuit 26 by the selective switching circuit 7a and the divided signals are distributed to all m electronic scanning type array antenna units 4 through the selective switching circuits $7_{bl}$–$7_{bm}$, respectively. These distributed signals are transmitted to the composition/-distribution circuits 3 of an electronic scanning type array antennas 4, and the signals are further distributed to antenna elements 1 through phase shifters 2 by the antenna element composition/distribution circuits 3 to be radiated into the space. At this time, proper phase shift quantities are given to phase shifters 2 by control signals from the control circuit 8; therefore the signals radiated from m by n antenna elements 1 are composed in the space to form a beam to be radiated in the desired direction.

In the case of a receiving operation, a signal is transmitted in the reverse direction and the signal is output from the input/output terminal 9.

Figure 1:
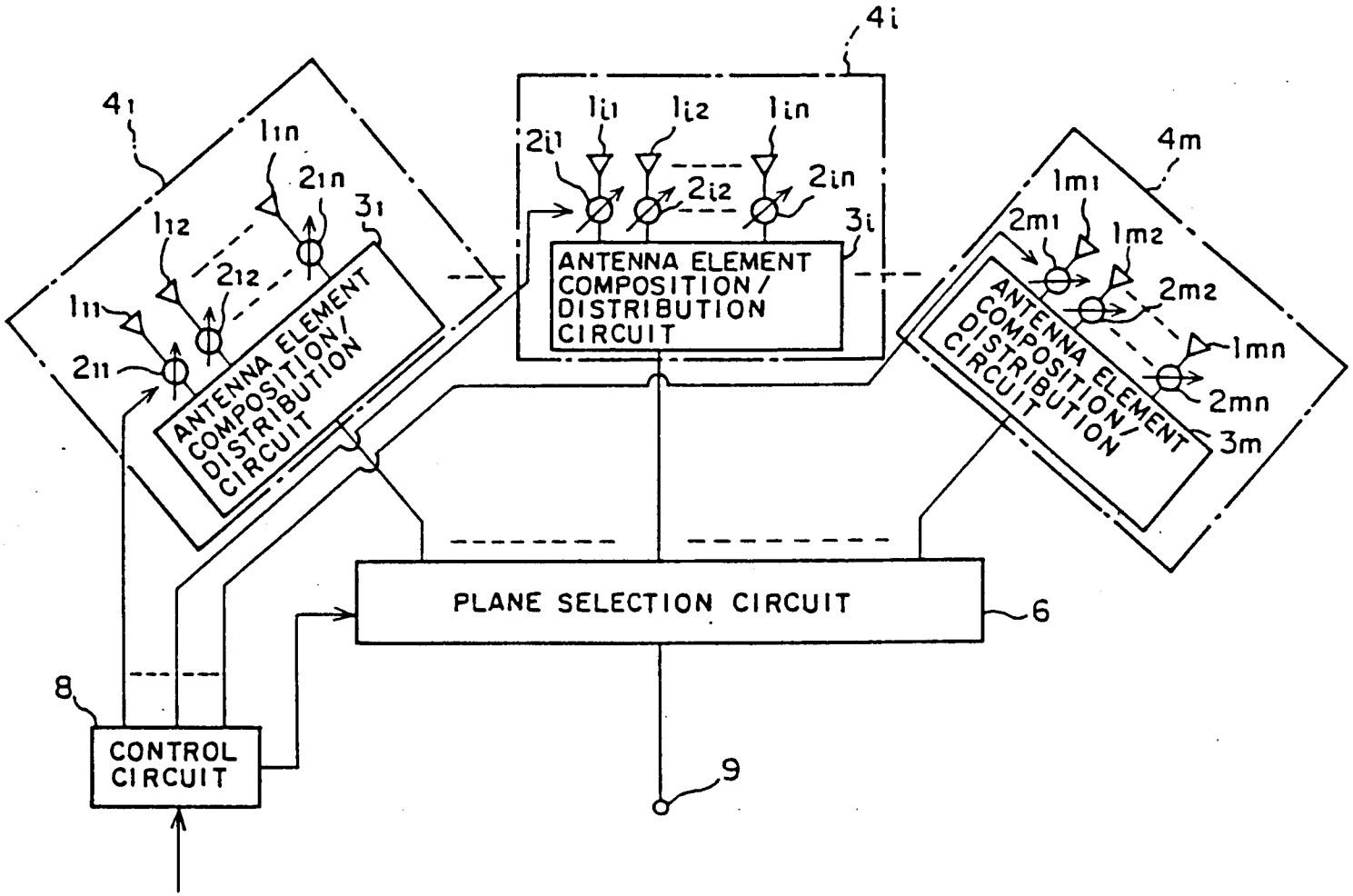
FIG. 1 (PRIOR ART)
FIG. 1 is a block diagram showing a conventional electronic scanning type array antenna device.
Figure 2:
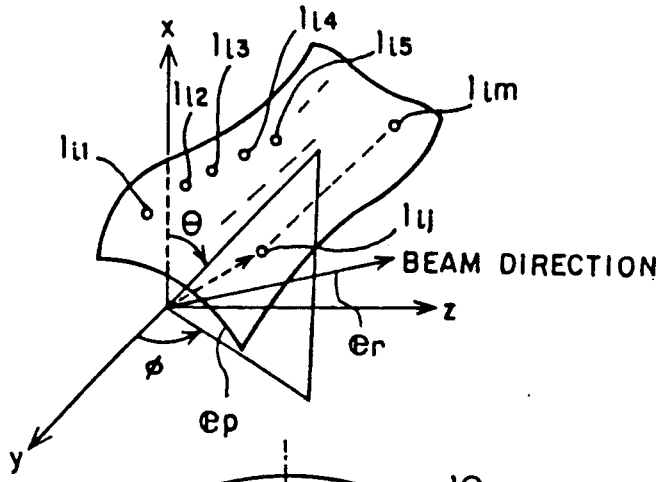
FIG. 2 is a coordinate system diagram showing a vector expressing the position of an antenna element and a vector expressing the direction of a beam of an antenna element.
Figure 3:
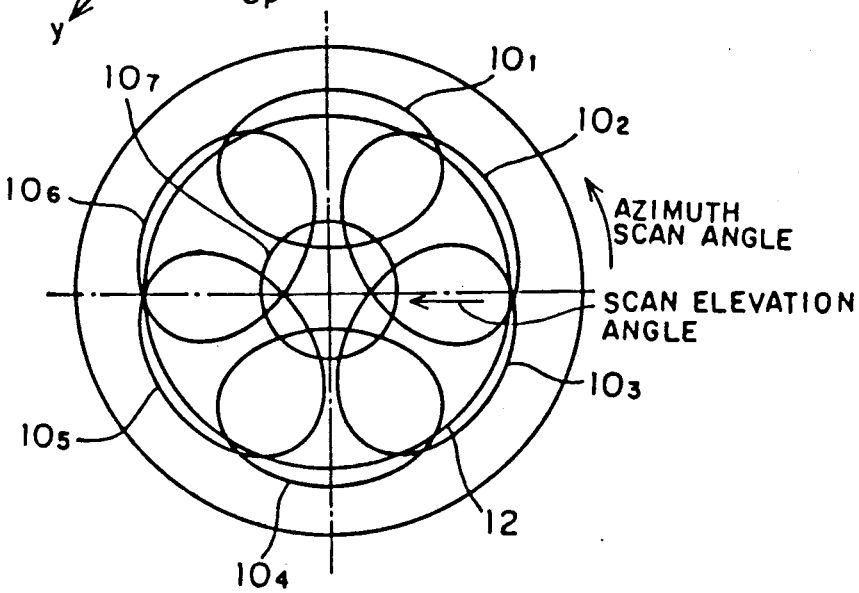
FIG. 3 and FIG. 4 are charts showing the beam coverages of a conventional electronic scanning type array antenna device.
Figure 4:
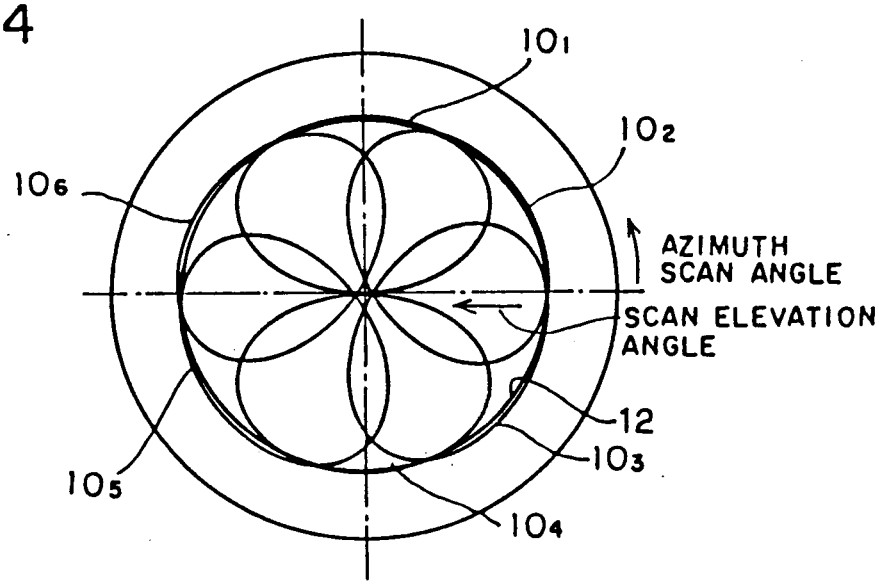

The present embodiment makes it possible to select not only one but also two or all of m units of electronic scanning type array antennas 4, thereby realizing an electronic scanning type array antenna device which is able to scan a wide range with a smaller number of antenna elements and phase shifters compared with that in a conventional device. (For example, in the present embodiment the number of antenna elements and phase shifters is decreased to four-seventh (4/7) as seen from the comparison between FIG. 6 and FIG. 3.)

The composition/distribution switching circuit 26 for composing and distributing the signals from/to two or all of m units of electronic scanning type array antennas 4 in the above embodiment, may be replaced with a circuit for composing and distributing the signals from/to any two or more, or all of m units of electronic scanning type array antenna units 4.

Figure 7:
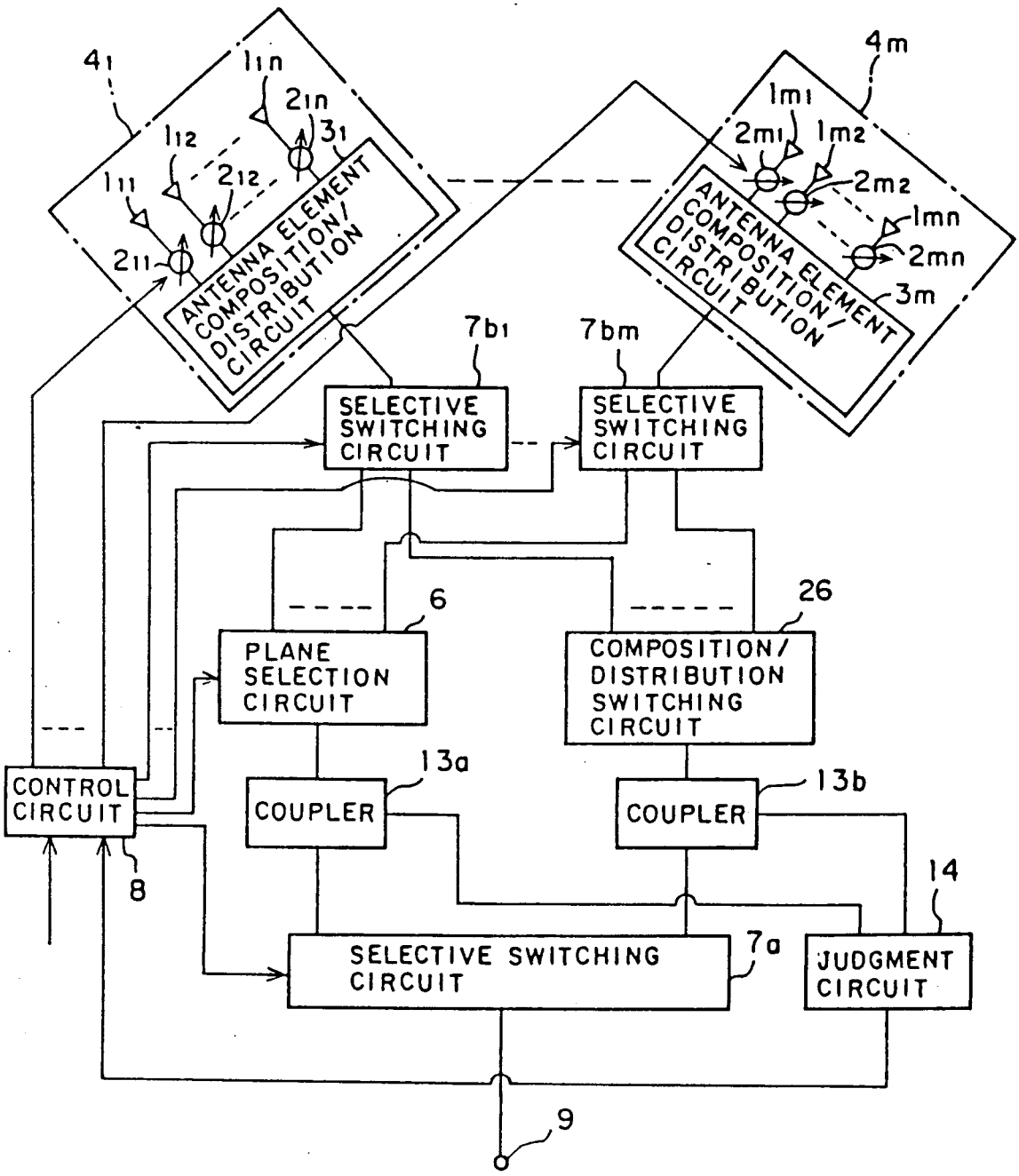
FIG. 7 is a block diagram showing an electronic scanning type array antenna device according to another embodiment of the present invention.

In FIG. 7, there are provided couplers 13a and 13b; one takes out a part of a composed signal of any one unit out of m units of electronic scanning type array antennas 4 transmitted from the plane selection circuit 6, and the other one takes out a part of a composed signal of any two or more, or all of m units of electronic scanning type array antennas 4 transmitted from the composition/distribution switching circuit 26; and a judgment circuit 14 which compares the values of the signal levels from the couplers 13a and 13b.

Figure 8:
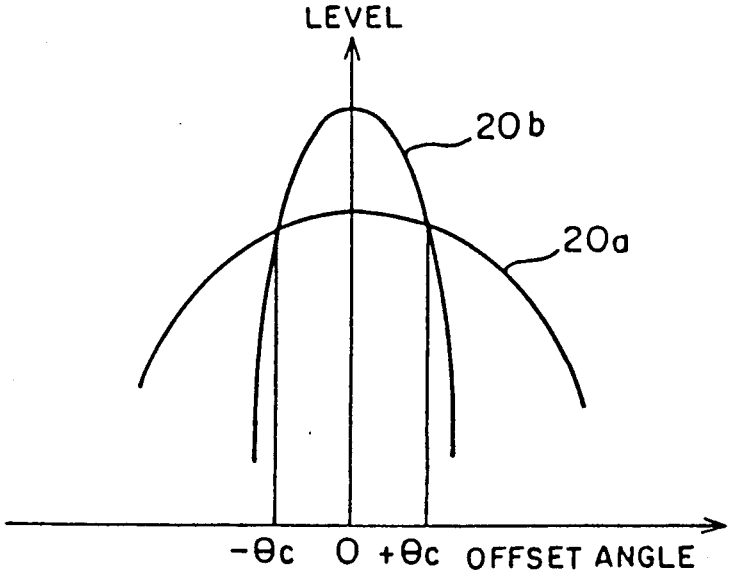
FIG. 8 is a chart showing an example of radiation patterns of the device shown in FIG. 7.

FIG. 8 shows an example of radiation patterns of the device shown in FIG. 7. The field intensity level at the beam center of a radiation pattern 20a of a composed signal of any one unit out of m units of electronic scanning type array antennas 4 is lower than that of a radiation pattern 20b of a composed signal of all m units of electronic scanning type array antennas 4 but the beamwidth of the pattern 20a is wider than that of the pattern 20b, and in the range outside the offset angle $+\theta_c$ the level of the pattern 20a becomes rather higher than that of the pattern 20b.

When a beam is directed to a target, there can be an angle error caused by environmental conditions or by the error of a sensor; if the angle error is larger than the $\theta_c$, a composed signal of any one unit out of m units of electronic scanning type array antennas 4 is selected by the judgment circuit 14 and by inputting the resultant information to a control circuit 8 one of the composed signals having higher receiving level is always selected.

Figure 9:
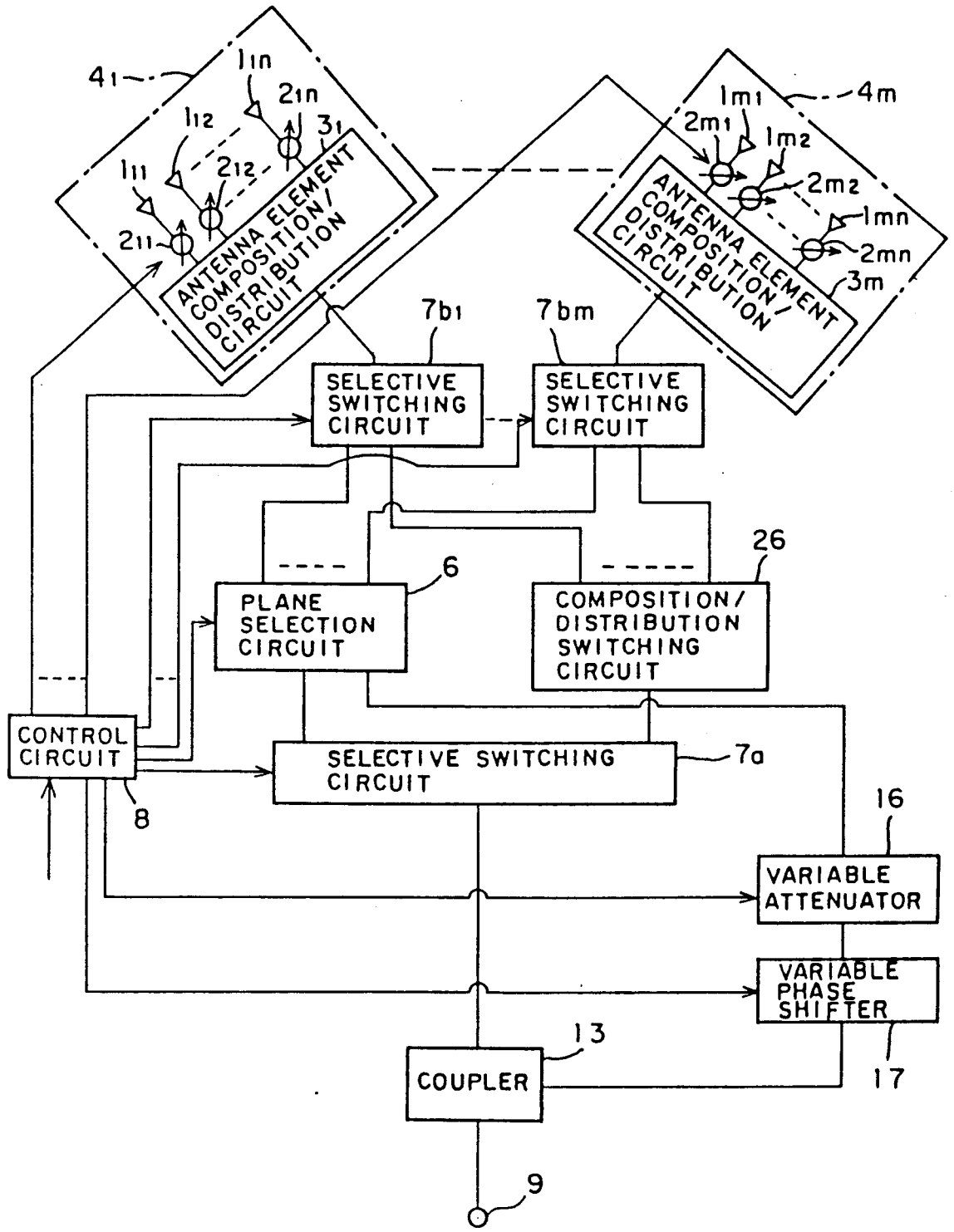
FIG. 9 is a block diagram showing an electronic scanning type array antenna device according to the third embodiment of the present invention.

FIG. 9 shows a constitution in which an auxiliary signal is taken out by selecting any one unit out of m units of electronic scanning type array antennas 4 with the plane selection circuit 6 apart from the main signal; there are provided in the signal path a variable attenuator 16 and a variable phase shifter 17 in which the attenuation quantity in passing through and the phase shift quantity in passing through can be varied; further a coupler 13 is provided which is to couple the auxiliary signal to a main signal output from the selective switching circuit 7a.

Figure 10:
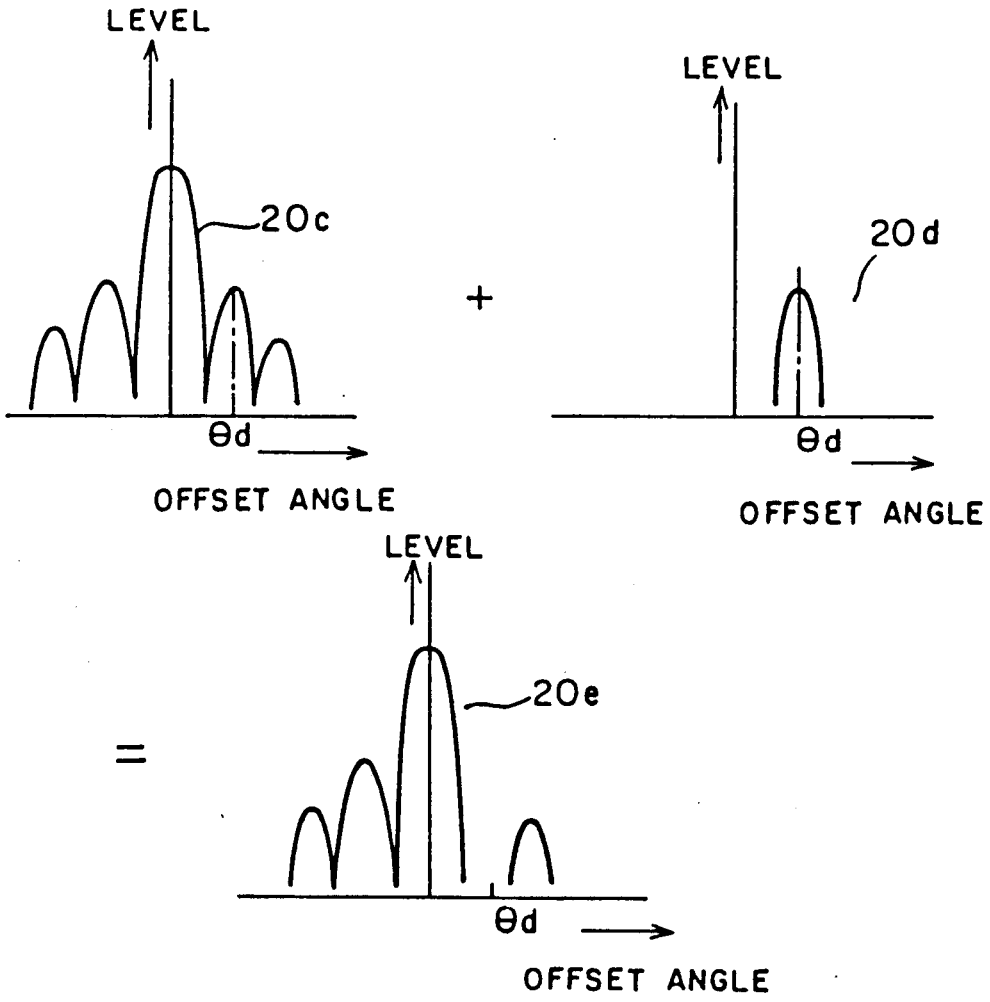
FIG. 10 is a chart showing an example of radiation patterns of the device shown in FIG. 9.

FIG. 10 shows a radiation pattern 20c of the main signal, a radiation pattern 20d of the auxiliary signal and a radiation pattern 20e of the main signal superimposed with the auxiliary signal. For example, the radiation pattern 20d of an auxiliary signal output from the plane selection circuit 6 is formed so that its main beam can be generated in the direction $\theta_d$ where a side lobe of the main signal is found by controlling the phase shifter 2 with the control circuit 8; the field intensity level is adjusted to be identical to that of the main signal radiation pattern 20c in the direction $\theta_d$ by controlling the variable attenuator 16 with the control circuit 8; and the phase angle is adjusted to have a phase difference of 180 degrees from that of the main signal radiation pattern in the direction $\theta_d$ by controlling the variable phase shifter 17 with the control circuit 8. When the main signal radiation pattern 20c is superimposed with the auxiliary signal radiation pattern 20d in the coupler 13, the main signal radiation pattern 20e superimposed with the auxiliary signal radiation pattern is output from an input-/output terminal of signals. In this case, a null point is generated in the direction $\theta_d$; therefore it is possible to decrease side lobes, to decrease the effect of unnecessary reflected waves, or to remove the signal from a pseudo-target.

As described in the above, an electronic scanning type array antenna device according to the present invention is so constituted that a signal is supplied to or received from arbitrarily selected one, two or more or all of electronic scanning type array antenna units to be operated, thereby decreasing in number of antenna elements and phase shifters. Accordingly the device is downsized and made light weight, and also has a wide beam scanning range.

What is claimed is:

1. An electronic scanning type array antenna device having desired directivity and gain, comprising:

a plurality of electronic scanning type array antenna units, each of which includes a plurality of antenna elements, an antenna element composition/distribution circuit for distributing exciting signals to antenna elements in transmission and for composing signals from the antenna elements into a receive signal in receiving, and a plurality of phase shifters for controlling the phase of signals coupled between said antenna elements and said antenna element composition/distribution circuit;

a plane selection circuit for supplying said exciting signal to any one unit selected out of said plurality of electronic scanning type array antenna units in transmission and for compositing the received signal from the selected antenna unit in receiving;

a composition/distribution switching circuit for distributing and supplying said exciting signal to any two or more units selected out said plurality of electronic scanning type array antenna units in transmission and for composing the received signal from said selected antenna units in receiving;

a first selective switching circuit, responsive to said exciting signal from either said plane selection circuit or said composition/distribution switching circuit, or responsive to said received signal, for selectively activating a predetermined number of said plurality of electronic scanning type array antenna units;

a second selective switching circuit, synchronized with said first selective switching circuit and responsive to said exciting signal or said received signal for selecting said plane selection circuit or said composition/distribution switching circuit;

a control circuit for controlling said phase shifters, said plane selection circuit, said composition/distribution switching circuit, and said first and second selective switching circuits; and a judgment circuit for level comparison in receiving between a first signal, derived from said received signal, from the plane selection circuit, which is from said unit selected out of the plurality of electronic scanning type array antenna units and a second signal, derived from said received signal, from the composition/distribution switching circuit, which is composed of the signals from said two or more units selected out of the plurality of electronic scanning type array antenna units.

2. The electronic scanning type array antenna device according to claim 1, wherein the first and second selective switching circuits select an exciting signal from an input terminal during transmission and transmit said exciting signal via said plane selection circuit or said composition/distribution switching circuit to the plurality of electronic scanning type array antenna units and wherein the first and second selective switching circuits select a received signal from the plurality of electronic scanning type array antenna units and transmit said received signal via said plane selection circuit or said composition/distribution switching circuit to an output terminal during reception.

3. An electronic scanning type array antenna device according to claim 1, further comprising:

a variable attenuator to which a part of said received signal from the unit selected out of the plurality of electronic scanning type array units by the plane selection circuit, is supplied as an input signal, and which variably attenuates said input signal under control of a control signal from said control circuit;

a variable phase shifter which varies a phase of attenuated signal supplied thereto from said variable attenuator under control of a control signal from said control circuit; and a coupler which couples a phase shifted signal output from said variable phase shifter together with said received signal from the selected unit.

4. An electronic scanning type array antenna device according to claim 1, wherein the control circuit either enables the plane selection circuit or enables the composition/distribution switching circuit depending upon the output from the judgment circuit.

* * * * *